US007322156B1

(12) United States Patent
Rillie et al.

(10) Patent No.: US 7,322,156 B1
(45) Date of Patent: Jan. 29, 2008

(54) SKYLIGHT DOMES WITH REFLECTORS

(75) Inventors: David Windsor Rillie, Cardiff, CA (US); Joseph W. Prenn, San Diego, CA (US)

(73) Assignee: Solatube International, Inc., Vista, CA (US)

( * ) Notice: Subject to any disclaimer, the term of this patent is extended or adjusted under 35 U.S.C. 154(b) by 915 days.

(21) Appl. No.: 10/195,770

(22) Filed: Jul. 12, 2002

(51) Int. Cl.
*E04D 13/03* (2006.01)
*E04B 7/18* (2006.01)

(52) U.S. Cl. ..... 52/200; 359/592

(58) Field of Classification Search ..... 52/200, 52/72; 359/592–598
See application file for complete search history.

(56) References Cited

U.S. PATENT DOCUMENTS 2,682,134 A * 6/1954 Stookey ..... 359/591
2,749,794 A * 6/1956 O'Leary ..... 359/599
2,858,734 A * 11/1958 Boyd ..... 359/593
3,127,699 A * 4/1964 Wasserman ..... 52/22
3,709,583 A * 1/1973 Pfannkuch et al. ..... 359/593
4,283,451 A * 8/1981 Abrahami ..... 428/182
4,351,588 A * 9/1982 Zullig ..... 359/592
4,519,675 A * 5/1985 Bar-Yonah ..... 359/595
4,839,781 A * 6/1989 Barnes et al. ..... 362/299
4,989,952 A * 2/1991 Edmonds ..... 359/592
5,099,622 A * 3/1992 Sutton ..... 52/200
5,204,777 A * 4/1993 Curshod ..... 359/596
5,408,795 A * 4/1995 Eljadi et al. ..... 52/173.3
5,467,564 A * 11/1995 DeKeyser et al. ..... 52/173.3
5,493,824 A * 2/1996 Webster et al. ..... 52/200
5,648,873 A * 7/1997 Jaster et al. ..... 359/591
5,655,339 A * 8/1997 DeBlock et al. ..... 52/200
5,896,712 A * 4/1999 Chao ..... 52/200
5,896,713 A * 4/1999 Chao et al. ..... 52/200
5,983,581 A * 11/1999 DeBlock et al. ..... 52/200
5,999,323 A * 12/1999 Wood ..... 359/591
6,035,593 A * 3/2000 Chao et al. ..... 52/200
6,178,707 B1 * 1/2001 Bengtson ..... 52/200
6,256,947 B1 * 7/2001 Grubb ..... 52/200
6,424,406 B1 * 7/2002 Mueller et al. ..... 359/613
6,433,932 B1 * 8/2002 Aoki et al. ..... 359/597
6,493,145 B1 * 12/2002 Aoki et al. ..... 359/597
RE38,217 E * 8/2003 DeBlock et al. ..... 52/200
6,623,137 B1 * 9/2003 Marsonette ..... 362/145
6,980,728 B2 * 12/2005 Ladstatter et al. ..... 385/146
7,070,314 B2 * 7/2006 Edmonds ..... 362/600

* cited by examiner

*Primary Examiner*—Robert Canfield
(74) *Attorney, Agent, or Firm*—John L. Rogitz

(57) ABSTRACT

A skylight cover includes a transparent lens and an opaque reflector attached to the inside of the cover opposite the lens. Light entering the lens can be refracted by the lens so that it reflects off of the reflector and into a tubular skylight assembly. Thus, the amount of light entering the tubular skylight assembly is maximized.

8 Claims, 4 Drawing Sheets

SKYLIGHT DOMES WITH REFLECTORS

I. FIELD OF THE INVENTION

The present invention relates generally to skylight domes.

II. BACKGROUND OF THE INVENTION

In U.S. Pat. Nos. 5,896,712 and RE36,496, both of which are owned by the same assignee as is the present invention and both of which are incorporated herein by reference, skylight covers are disclosed. These skylight covers can be used in conjunction with the tubular skylights disclosed in U.S. Pat. Nos. 5,896,713 and 6,035,593 also owned by the same assignee as is the present invention and also incorporated herein by reference. These inventions represent advances over the prior art and one or more of them has found commercial success.

Briefly, a tubular skylight such as those mentioned above includes a tube assembly mounted between the roof and ceiling of a building. The top end of the tube assembly is covered by a roof-mounted dome or cover, such as the one disclosed in the above-mentioned '712 patent, while the bottom end of the tube assembly is covered by a ceiling-mounted diffuser plate. With this combination, natural light external to the building is directed through the tube assembly into the interior of the building to illuminate the interior.

As understood herein, when sunlight impinges on the earth at steep angles, e.g., during sunrise and sunset, much of the light reaching the skylight cover does not enter the tube and as such, does not get reflected through the tube and into the building. Accordingly, the present invention recognizes a need for a skylight cover that promotes the reflection light entering the skylight cover into the tube.

SUMMARY OF THE INVENTION

A skylight cover includes a transparent body having an opaque reflector disposed therein. A transparent member is also disposed within the transparent body. The transparent member includes a reflective element.

Preferably, the transparent element is a face that is established by a slot. Specifically, the transparent member is a lens that has plural slots formed therein. These slots establish reflective faces. In a preferred embodiment, the slots are parallel to each other. Moreover, the opaque reflector is spaced from a longitudinal axis established by the body.

In another aspect of the present invention a skylight cover has a major surface and a minor surface that is smaller than the major surface. The major surface includes a lens formed thereon to redirect at least some light impinging thereon.

In still another aspect of the present invention, a cover is disposable on a roof of a building for covering a skylight. In this aspect, this cover includes a plastic transparent body that defines a longitudinal axis. Also, the body has an asymmetrical cross-section normal to the axis. The body further includes a lens area formed thereon.

In yet another aspect of the present invention, a skylight cover includes a transparent body. This aspect of the present invention also includes a transparent member inside the body. The transparent member includes a reflective element.

In yet still another aspect of the present invention, a method is provided for using a skylight cover that has a body and plural lenses formed therein. In this method the skylight cover is installed on a roof so that the lenses face south in the northern hemisphere. Alternatively, in the southern hemisphere, the skylight cover is installed on a roof so that the lenses face north.

In another aspect of the present invention, a method is provided for making a lens. In this method, two transparent strips are provided. These strips are connected along the edges so that a groove is formed between the strips.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
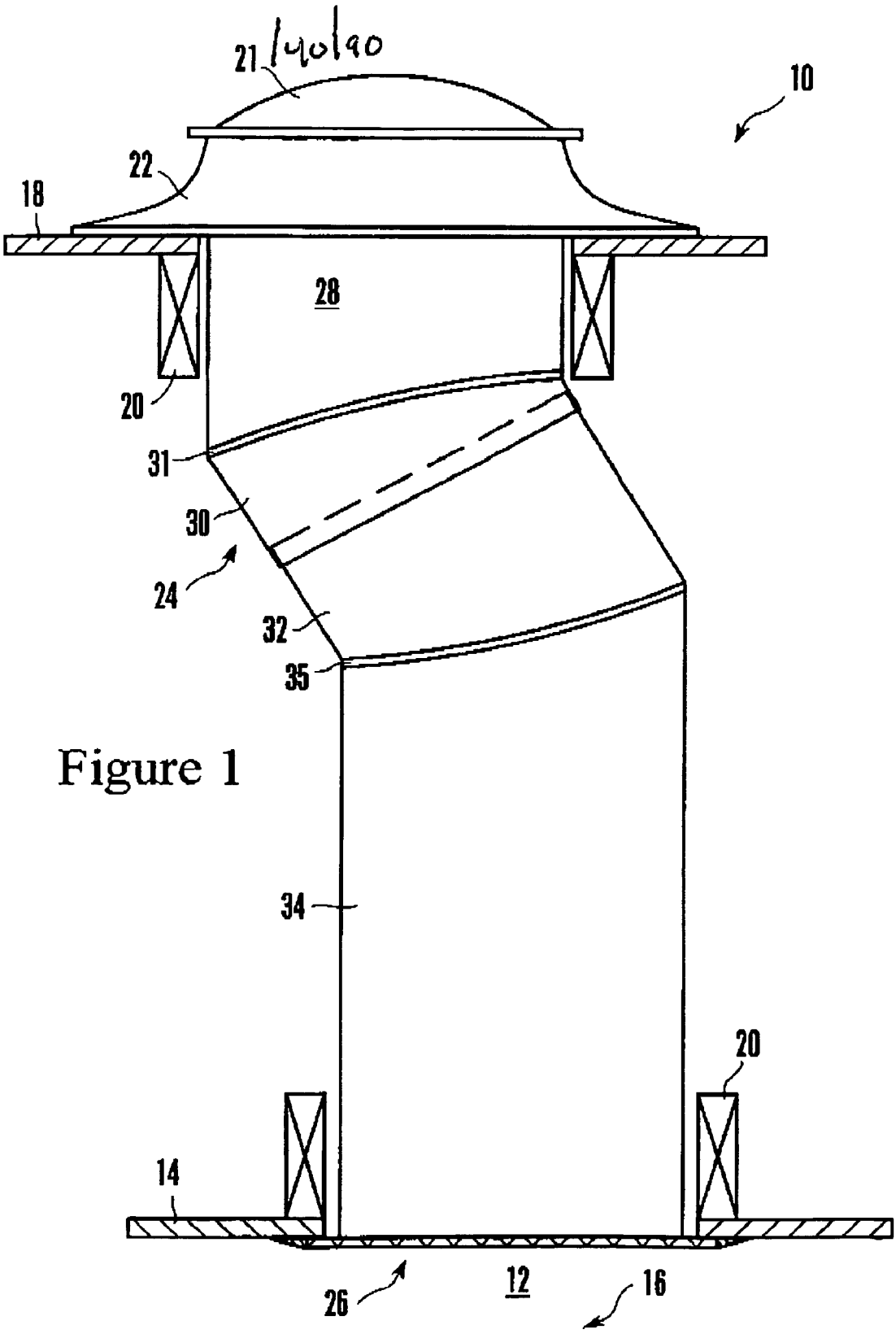
FIG. 1 is a side view in partial cross-section of a tubular skylight.

Referring initially to FIG. 1, an exemplary non-limiting tubular skylight made in accordance with the present invention is shown, generally designated 10, for lighting, with natural sunlight, an interior room 12 having a ceiling surface 14, e.g., drywall, acoustic tile, etc., in a building, generally designated 16. FIG. 1 shows that the building 16 has a roof 18 and one or more joists 20 that support the roof 18 and ceiling surface 14.

As shown in FIG. 1, the skylight 10 includes a rigid hard plastic roof-mounted cover 21. The cover 21 is optically transmissive and preferably is transparent. In one embodiment, the cover 21 can be the cover disclosed in the above-mentioned '712 patent. Or, the cover 21 can be other suitable covers, such as the covers marketed under the trade name "Solatube" by the present assignee.

The cover 21 is mounted to the roof 18 by means of a ring-like metal flashing 22 that is attached to the roof 18 by means well-known in the art. The metal flashing 22 can be angled as appropriate for the cant of the roof 18 to engage and hold the cover 21 in the generally vertically upright orientation shown.

As further shown in FIG. 1, an internally reflective metal tube assembly, generally designated 24, is connected to the flashing 22. The tube assembly 24 extends to the ceiling 14 of the interior room 12. Per the present invention, the tube assembly 24 directs light that enters the tube assembly 24 downwardly to a light diffuser assembly, generally designated 26, that is disposed in the room 12 and that is mounted to the ceiling 14 or to a joist 20 as described in the above-mentioned '593 patent.

The tube assembly 24 can be made of a metal such as an alloy of aluminum, or the tube assembly 24 can be made of fiber or plastic or other appropriate material. The interior of the tube assembly 24 is rendered reflective by means of, e.g., electroplating, anodizing, metalized plastic film coating, or other suitable means. In one preferred embodiment, the tube assembly 24 is rendered internally reflective by laminating the inside surface of the tube assembly with a multi-ply polymeric film made by Minnesota Mining and Manufacturing (3M). A single ply of such film is transparent, but when hundreds of layers are positioned flush together and then laminated to the interior surface of the tube assembly 24, the combination is highly reflective, i.e., over ninety-five percent (95%) reflective and indeed, over ninety-nine percent (99%) reflective. By ninety-nine percent (99%) reflective, it is meant that ninety-nine percent (99%) of an incident light beam is reflected back off the film.

In one preferred embodiment, the tube assembly 24 is established by a single tube. However, as shown in FIG. 1, if desired, the tube assembly 24 can include multiple segments, each one of which is internally reflective in accordance with present principles. Specifically, the tube assembly 24 can include an upper tube 28 that is engaged with the flashing 22 and that is covered by the cover 21. Also, the tube assembly 24 can include an upper intermediate tube 30 that is contiguous to the upper tube 28 and that can be angled relative thereto at an elbow 31 if desired. Moreover, the tube assembly 24 can include a lower intermediate tube 32 that is slidably engaged with the upper intermediate tube 30 for absorbing thermal stresses in the tube assembly 24. And, a lower tube 34 can be contiguous to the lower intermediate tube 32 and join the lower intermediate tube 32 at an elbow 35, with the bottom of the lower tube 34 being covered by the diffuser assembly 26. The elbow 35 is angled as appropriate for the building 16 such that the tube assembly 24 connects the roof-mounted cover 21 to the ceiling-mounted diffuser assembly 26. It is to be understood that where appropriate, certain joints between tubes can be covered with tape in accordance with principles known in the art.

Figure 2:
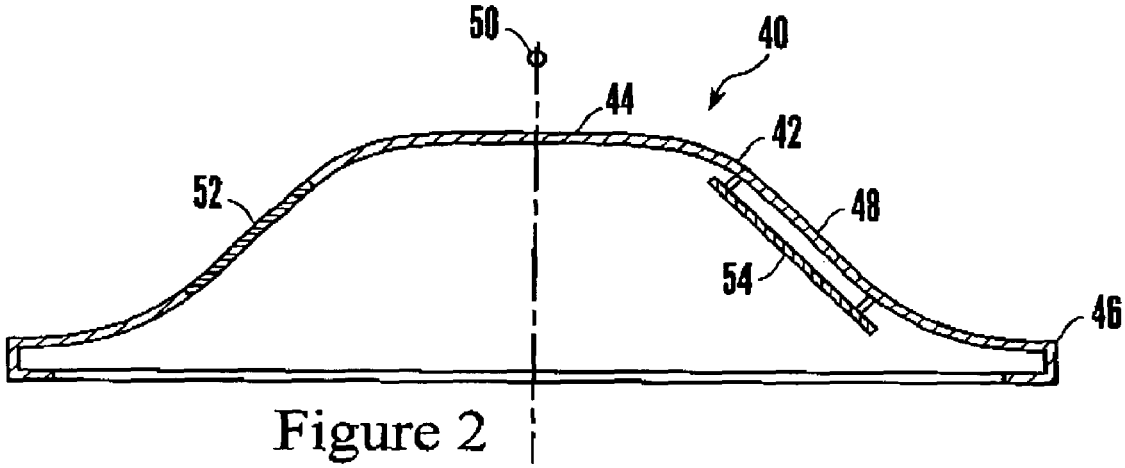
FIG. 2 is a cross-section view of a first embodiment of the skylight cover.

Referring to FIG. 2, a preferred embodiment of a skylight cover is shown and is designated 40. FIG. 2 shows that one preferred, non-limiting embodiment of the skylight cover 40 includes a generally dome-shaped body 42 that defines a top 44 and a periphery 46 opposed to the top 44. The dome-shaped body 42 further includes a sidewall 48 that is established between the top 44 and periphery of the body 42. It is to be understood that the dome-shaped body 42 is preferably transparent to allow light to pass there through and enter the tube assembly 24. As shown, a vertical axis 50 is defined by a line passing through the cover 40 perpendicular to the plane of the periphery 46, it being understood that the axis 50 is generally vertical when the cover 40 is oriented on the roof 18 as intended and shown in FIG. 1.

FIG. 2 shows that a transparent, reflective lens 52 can be incorporated into the dome-shaped body 42. The lens 52 can be flat and generally rectangular shaped or as shown the lens 52 can be curved to match the shape of the sidewall 48 of the dome 40. Further details concerning the lens 52 are discussed below in reference to FIGS. 3 and 4. As shown in FIG. 2, a highly polished, preferably opaque reflector 54 is attached to the interior surface of the dome-shaped body 42 opposite the lens 52 in order to reflect light down through the tube assembly 24. Thus, depending on the angle at which light impinges on the cover 40, some light can be redirected into the tube assembly 24 by the lens 52. Other light can pass directly through the lens 52 and be reflected into the tube assembly 24 by the reflector 54.

Figure 3:
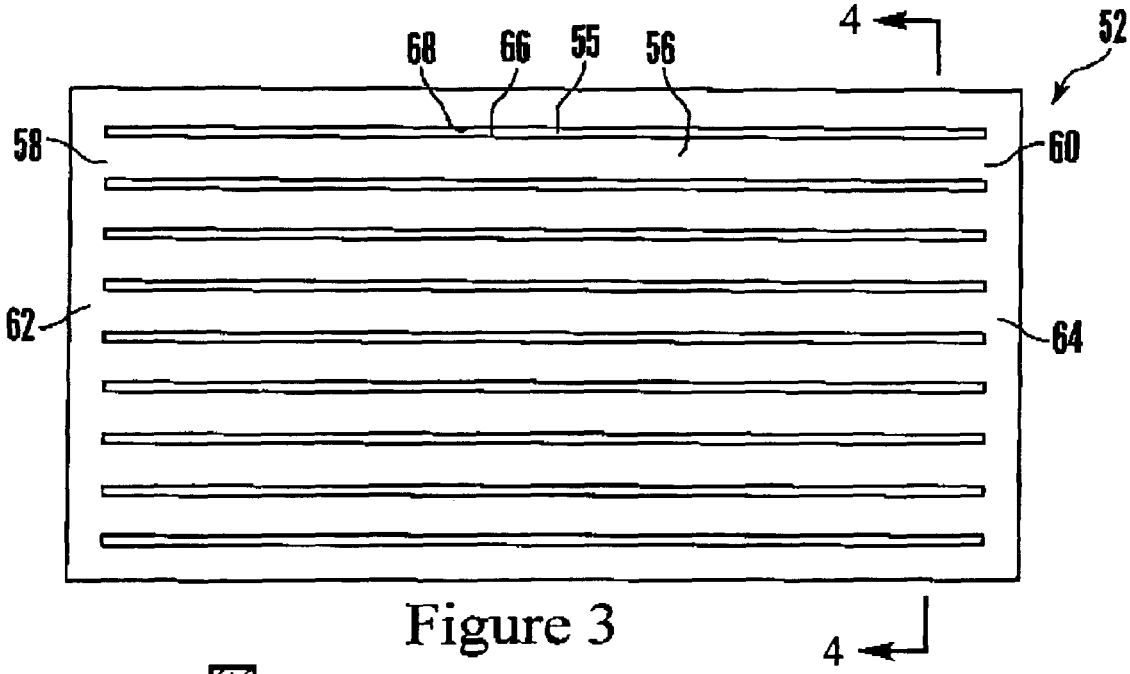
FIG. 3 is a top plan view of a preferred lens.
Figure 4:
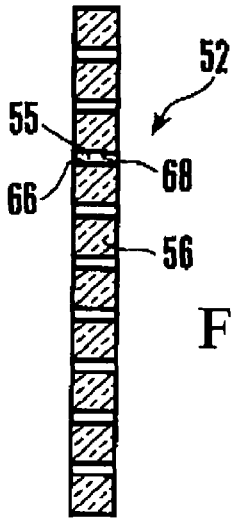
FIG. 4 is a cross-section view of the preferred lens taken along line 4-4 in FIG. 3.

Referring now to FIGS. 3 and 4, details concerning the lens 52 are shown. FIGS. 3 and 4 show that in a preferred embodiment the lens 52 includes plural longitudinal slots 54 that are established between plural longitudinal strips 56. Each longitudinal strip 56 defines a first end 58 and a second end 60. Additionally, as shown in FIG. 3, the first end 58 of each longitudinal strip 56 is connected to a first end cap 62 and the second end 60 of each longitudinal strip 56 is connected to a second end cap 64.

It is to be understood that the structure of the lens 52 described above can be manufactured by cutting the slots 54 in a solid piece of material, e.g., using a laser. However, if desired, the lens 52 can manufactured by placing the longitudinal strips 56 on a template so that they are parallel to each other and spaced apart from each other (in order to establish the slots 54). Then, the end caps 62, 64 are laminated or otherwise affixed to the ends 58, 60 of the strips 56. In either case, as shown in FIGS. 3 and 4, each slot 54 is flanked by a first and second reflective face 66, 68 that can refract light passing through the lens 52 so that it can be reflected by the reflector 54 into the tube assembly 24.

Figure 5:
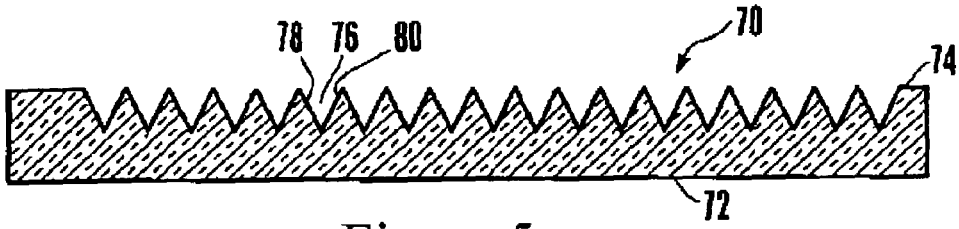
FIG. 5 is a side plan view of an alternative lens.

Referring to FIG. 5, an alternative lens is shown and is designated 70. FIG. 5 shows that the alternative lens 70 has a lower surface 72 and an upper surface 74. As shown, plural triangular shaped grooves 76 are established in the upper surface 74 so that the upper surface 74 has a "saw-tooth" cross-section. Each groove 76 is flanked by a first and second angled surface 78, 80. These angled surfaces 78, 80 refract light passing through the lens 70 so that it can be reflected down the tube assembly 24. It can be appreciated that when the lens 70 is installed in a skylight cover, e.g., the skylight cover described in conjunction with FIG. 2, the grooves 76 can be facing either outward (i.e., up) or inward (i.e., down).

Figure 6:
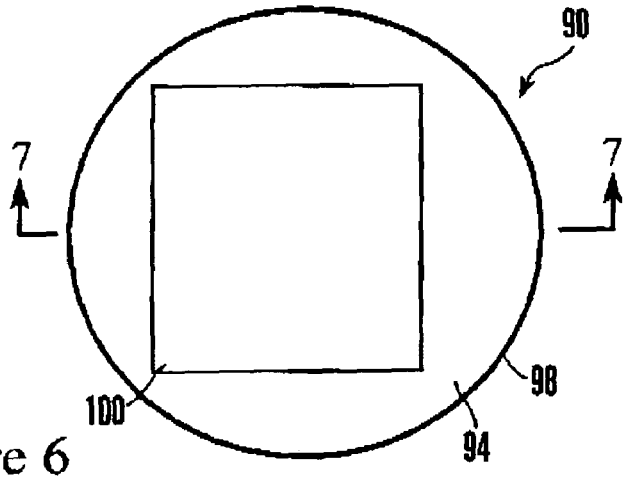
FIG. 6 is a top plan view of a second embodiment of the skylight cover.
Figure 7:
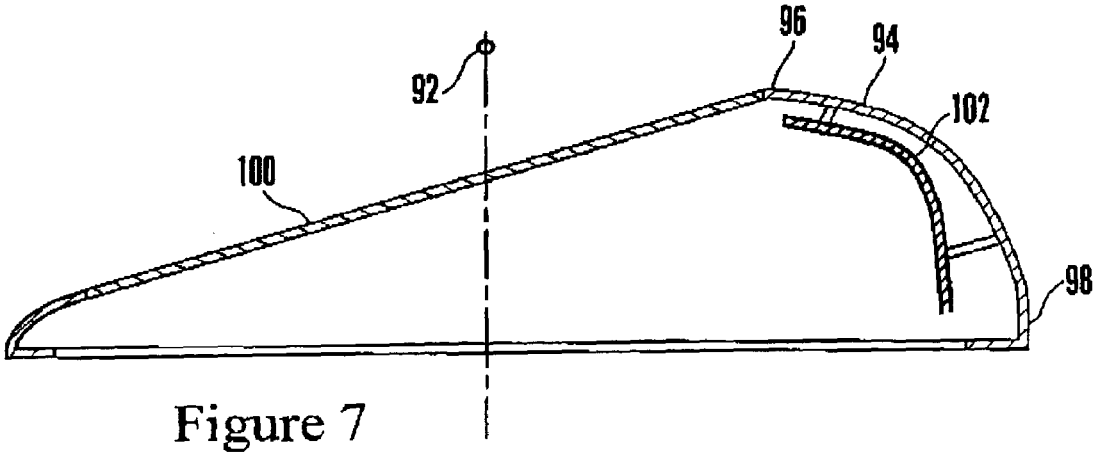
FIG. 7 is a cross-section view of the second alternative tubular skylight cover taken along line 7-7 in FIG. 6.

FIGS. 6 and 7 show an alternative skylight cover 90. FIGS. 6 and 7 show that this embodiment of the skylight cover 90 defines a longitudinal axis 92 and includes a transparent, body 94 that has an asymmetric cross-section normal to the axis 92. The asymmetric body 94 defines a top 96 and a generally circular periphery 98 that is opposed to the top 96.

As shown in FIGS. 6 and 7, a lens 100 can be incorporated into the asymmetric body 94. It is to be understood that the lens 100 can be flat and generally rectangular shaped. Or, the lens 100 can be curved to match the shape of the asymmetric body 94. It is to be understood that the lens 100 can be configured similar to either lens 52, 70 described in conjunction with FIGS. 3 through 5.

FIGS. 6 and 7 further show that a highly polished, preferably opaque reflector 102 is attached to the interior surface of the asymmetric body 94 opposite the lens 100 in order to reflect light down through the tube assembly 24. Thus, depending on the angle at which light impinges on the cover 90, some light can be redirected into the tube assembly 24 by the lens 100. Other light can pass directly through the lens 100 and be reflected into the tube assembly 24 by the reflector 102.

Figure 8:
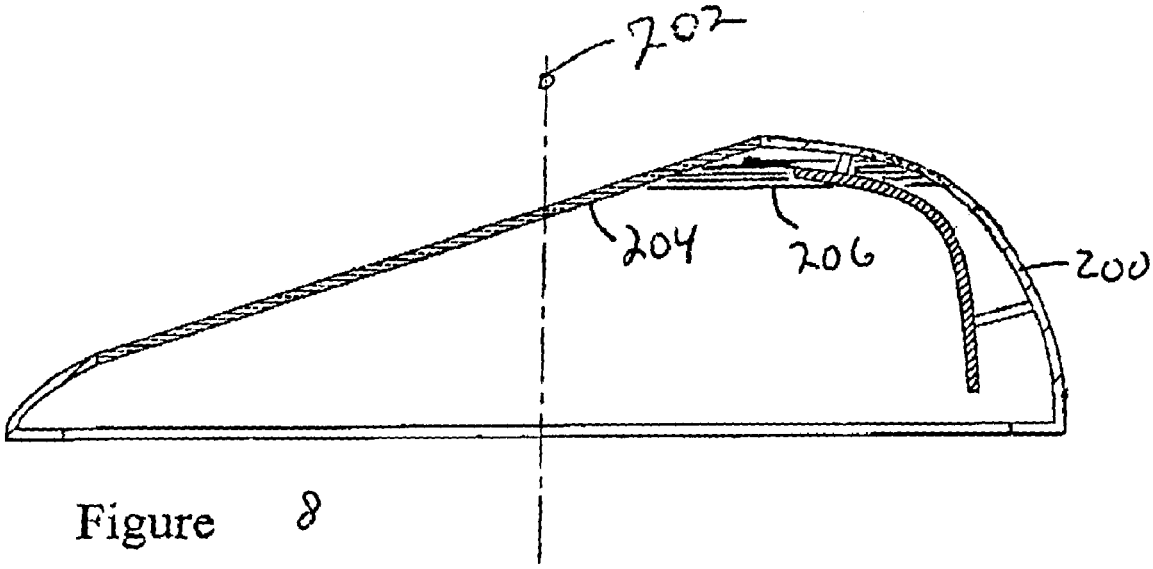
FIG. 8 is a cross-section view of an embodiment similar to FIG. 7, showing at least some grooves circumscribing the cover.

FIG. 8 shows a skylight cover 200 with longitudinal axis 202 that in all essential respects is identical to the cover 90 shown in FIGS. 6 and 7, including having an asymmetric cross-section normal to the axis 202 and a lens 204 that is incorporated into the asymmetric cover 200, with the following exceptions. The lens 204 can be established by plural grooves 206, at least some of which, as shown at 206, circumscribe the surface of the cover and are perpendicular to the axis 202.

While the particular SKYLIGHT DOMES WITH REFLECTORS is herein shown and described in detail and is fully capable of attaining the above-described objects of the invention, it is to be understood that the invention is limited only by the express language of the claims.

We claim:

1. A cover disposable on a roof of a building for covering a skylight, comprising:

a plastic transparent body defining a longitudinal axis and having an asymmetrical cross-section normal to the axis; and a lens area formed on the body, the lens area including plural grooves, wherein at least some grooves circumscribe the surface of the body.

2. The skylight cover of claim 1, wherein each groove has a sawtooth cross-section.

3. The skylight cover of claim 1, wherein at least some grooves are perpendicular to the axis.

4. A cover disposable on a roof of a building for covering a skylight, comprising:

a plastic transparent body defining a longitudinal axis and having an asymmetrical cross-section normal to the axis; and a lens area formed on the body; and at least one opaque reflector within the body.

5. A skylight cover, comprising:

a transparent body;

at least one transparent member inside or on the body and defining at least one reflective element; and at least one opaque reflector inside the body and being positioned to receive sunlight from above the cover and reflected toward the reflector by the reflective element.

6. The skylight cover of claim 5, wherein the reflective element is at least one face established by a slot.

7. The skylight cover of claim 6, wherein the transparent member is a plate having plural slots formed therein, the slots establishing reflective faces.

8. The skylight cover of claim 7, wherein the slots are parallel to each other.

* * * * *